US011008724B2

(12) United States Patent
Wang et al.

(10) Patent No.: US 11,008,724 B2
(45) Date of Patent: May 18, 2021

(54) VARIABLE-DIAMETER REINFORCING CAGE FOR ANCHOR ROD OR PILE FOUNDATION

(71) Applicant: JIANGSU GREEN RIVER ENVIRONMENTAL TECHNOLOGY CO., LTD., Nanjing (CN)

(72) Inventors: Lin Wang, Nanjing (CN); Gang Tao, Nanjing (CN); Jun Wang, Nanjing (CN)

(73) Assignee: JIANGSU GREEN RIVER ENVIRONMENTAL TECHNOLOGY CO., LTD., Nanjing (CN)

( * ) Notice: Subject to any disclaimer, the term of this patent is extended or adjusted under 35 U.S.C. 154(b) by 0 days.

(21) Appl. No.: 16/611,487

(22) PCT Filed: Feb. 8, 2018

(86) PCT No.: PCT/CN2018/075783
§ 371 (c)(1),
(2) Date: Nov. 7, 2019

(87) PCT Pub. No.: WO2018/205702
PCT Pub. Date: Nov. 15, 2018

(65) Prior Publication Data

US 2020/0165790 A1 May 28, 2020

(30) Foreign Application Priority Data

May 8, 2017 (CN) ..... 201710316124.4

(51) Int. Cl.
*E02D 27/12* (2006.01)
*E02D 5/38* (2006.01)
*E02D 5/44* (2006.01)

(52) U.S. Cl.
CPC ..... *E02D 5/38* (2013.01); *E02D 27/12* (2013.01); *E02D 5/44* (2013.01)

(58) Field of Classification Search
CPC .... E02D 5/38; E02D 5/74; E02D 5/76; E02D 27/12
See application file for complete search history.

(56) References Cited

U.S. PATENT DOCUMENTS 3,276,173 A * 10/1966 Bowman ..... E02D 5/54 52/164
3,750,609 A * 8/1973 Chelminski ..... E02D 7/28 114/295

(Continued)

FOREIGN PATENT DOCUMENTS

CN 102322061 A * 1/2012
CN 103850252 A 6/2014

(Continued)

*Primary Examiner* — Benjamin F Fiorello
(74) *Attorney, Agent, or Firm* — Treasure IP Group, LLC

(57) ABSTRACT

A variable-diameter reinforcing cage for an anchor rod or pile foundation, comprising an axial rod (4), a plurality of vertical bars (2), at least two circular fixators (5) and several groups of ribs (3) which correspond to the circular fixators (5). The circular fixators (5) are all sleeved on the axial rod (4); one end of the ribs (3) is movably connected to the position of the vertical bars (2) at the same height, and the other end of the ribs (3) is movably connected to the circular fixators (5); annular hoops (6) are arranged on the periphery of the vertical bars (2) to serve as circles of latitude; fixing points are formed on the annular hoops (6) and the vertical bars (2); and the annular hoops (6) are annular spiral spring hoops of an elastic material or flexible steel wires.

12 Claims, 9 Drawing Sheets

(56) References Cited

U.S. PATENT DOCUMENTS

| | | | | | |
|---|---|---|---|---|---|
| 4,952,097 | A * | 8/1990 | Kulchin | E02D 5/76 | 405/262 |
| 5,975,808 | A * | 11/1999 | Fujita | E02D 5/28 | 405/244 |
| 7,070,362 | B2 * | 7/2006 | Rasmussen | E02D 5/44 | 405/232 |
| 2005/0117977 | A1 * | 6/2005 | Rasumussen | E02D 5/44 | 405/253 |

FOREIGN PATENT DOCUMENTS

| | | | |
|---|---|---|---|
| CN | 106087984 | | 11/2016 |
| CN | 107119680 | A | 9/2017 |
| CN | 206736901 | U | 12/2017 |
| JP | 11286933 | | 10/1999 |
| WO | 03062539 | | 7/2003 |

* cited by examiner

VARIABLE-DIAMETER REINFORCING CAGE FOR ANCHOR ROD OR PILE FOUNDATION

CROSS REFERENCE TO RELATED APPLICATION

This application claims priority to a PCT application PCT/CN2018/075783, filed on Feb. 8, 2018, which in turn takes priority of Chinese Application No. 201710316124.4, filed on May 8, 2017. Both the PCT application and Chinese Application are incorporated herein by reference in their entireties.

I. TECHNICAL FIELD

This invention relates to a variable-diameter reinforcing cage for an anchor rod or pile foundation and its applications; especially the framework in an anchor rod or pile foundation—a variable-diameter reinforcing cage and its expanded anchor rod or pile foundation, is mainly used in anti-floating foundation pit supporting, slope supporting, geological disaster control, reinforcement, etc. as well as compression pile foundations for building basements. The invention provides a variable-diameter reinforcing cage that has large uplift resistance/compressive resistance and stable and reliable performance and is applied in an anchor rod or pile foundation.

II. BACKGROUND

The anchor rod must have several elements: a rod body with a tensile strength higher than that of the soil-rock mass: one end of the rod body can be in close contact with the soil-rock mass to form friction (or bonding) resistance; the anchor rod body is located at the other end of the soil-rock mass and can form a radial resistance to the soil-rock mass; as a tensile member deeply penetrating into strata, the anchor rod is connected to an engineering structure at one end and deeply penetrates into strata at the other end; the whole anchor rod is divided into a free section and an anchoring section; the free section refers to the area where the tension at the anchor rod head is transmitted to the anchoring body, and the function of the free section is to prestress the anchor rod; the anchoring section refers to the area where cement slurry or concrete anchoring bodies bond prestressed reinforcements with soil layers, and the function of the anchoring section is to increase the bonding friction between the anchoring body and soil layers as well as the bearing capacity or tensile force of the anchoring body and transmit the tension of the free section deeply to the soil mass.

On the whole, the anchor rod is a member system structure for soil-rock mass reinforcing. Depending upon the longitudinal tension of the anchor rod body, the shortcoming that the tensile strength of soil-rock mass is far lower than its compressive capacity is overcome. From the viewpoint of mechanics, the cohesion C and the internal friction angle $\varphi$ of the surrounding rock mass are mainly increased. In essence, the anchor rod is located in the soil-rock mass and forms a new complex with the soil-rock mass. The anchor rod in this complex is the key to solving the problem about the low tensile strength of the surrounding rock mass. Thereby, the bearing capacity of the soil-rock mass is greatly enhanced.

Anchor rods are the most basic component of the roadway support in underground mining in modern times. Anchor rods tie the surrounding rocks of a roadway together, so that the surrounding rocks support themselves. Now anchor rods are used in mines and also in construction engineering technologies, and actively reinforce basements, slopes, tunnels, dams, etc.

The basic type of anchor rods: steel bar or wire rope mortar anchor rods. Cement mortar is used as the binder for anchor rods and surrounding rocks. There are also inverted wedge metal anchor rods, pipe joint anchor rods, and resin anchor rods. The use of resin as a binder for anchor rods is costly.

Hui Xingtian of Xi'an University of Science and Technology invented a new type of spiral anchor rod→spinning anchor rod. There are multiple types of spinning anchor rods as follows: self-tapping extrusion screwing-in anchor rod→direct extrusion screwing-in and installation in soil layers without need for boring; anchoring force 20 KN/m; spinning grouting anchor rod→a spinning grouting anchor rod with initial anchoring force is formed by use of spinning anchor rod grouting after installation in a borehole; spinning resin anchor rod→a spinning resin anchor rod with initial anchoring force is formed through resin mixing at the same of installation in a borehole; self-drilling and self-anchoring rod→a self-drilling anchor rod with initial anchoring force is formed by placing drill pipe in the hollow of the spinning anchor and completing hole drilling and installation at a time; spinning shotcrete anchor rod→completion of installation, anchoring and grouting in soil layers at a time through guniting while drilling; anchoring force 35 KN/m;

At present, the expanded anchor rod technologies commonly used in the market include plain slurry expanded anchor rod technology, bag type expanded anchor rod technology, etc. In terms of construction cost, there is a foundation for the hole expanding technology for a reducer anchor rod or pile foundation. Grouting or concrete injection forms a reducer, but it does not involve a suitable reinforcement cage, a tension or resistance transmission anchor rod or pile foundation with sufficient friction cannot be formed, and especially the anchoring force of the anchor rod is limited. When this technology is used in anti-floating foundation pit supporting, slope supporting, reinforcement, etc. for building basements, the anchoring force is insufficient. This is because there is a need for large uplift resistance and high stability and reliability.

In addition, non-reducing foundation piles are often used in the foundations of high-rise buildings. On the premise of meeting the same strength and deformation requirements, in comparison with a non-reducing foundation pile, a variable-diameter foundation pile mainly has the following features:

1) at the same length, the strength of a variable-diameter foundation pile can be increased by 1.1 to 1.5 times, and its deformation can be reduced by 0.7 to 0.9 times.

2) Under the first feature condition, the strength and deformation requirements of buildings are met, and the pile length can be obviously shortened.

3) On the premise of meeting the strength and deformation requirements of the pile, the pile length is shortened, the workload is reduced, and the construction conditions are improved so as to save labor, materials and time.

The strength of some clay layers, soft layers, pebble layers, gravel layers or weathered rock formations tends to be lower than that of concrete, thus making against the bearing capacity of concrete foundation piles. Therefore, in order to give full play to the strength characteristics of concrete, there have been papers in the field of construction engineering proposing that the use of variable-diameter foundation piles to increasing the bearing capacity of piles is technically reasonable and feasible.

The calculation method for the strength and deformation of variable-diameter foundation piles is the same as that for the strength and deformation of non-reducing foundation piles. Foundation piles are divided into end bearing piles and friction piles. The calculation method for the strength and deformation of the two piles is different. Friction piles are used as the object for calculation and comparison. The strength of a friction pile generally consists of its side friction resistance and the strength of the pile end bearing layer. For a friction pile, the pile perimeter friction resistance is primary. However, for most foundation piles and especially large diameter piles, the pile end is supported by bedrocks, and the pile end bearing capacity is primary. Therefore, the calculation of the ultimate strength of the pile end bearing layer is very important, because the values obtained by different methods for calculating the strength of the pile end bearing layer vary greatly. The strength of the foundation pile bearing layer is related to the properties of rocks and soils as well as the burial depth and size of the pile foundation. It can be seen that the variable-diameter foundation pile is very promising in application, but how to obtain a feasible variable-diameter foundation pile is a problem to be solved.

III. SUMMARY OF THE INVENTION

The purpose of this invention is to provide a variable-diameter reinforcing cage and an expanded anchor rod or pile foundation and their preparation, apply the variable-diameter reinforcing cage for all expanded anchor rods resistant to tension and uplift and all compressive pile foundations, overcome the shortcomings such as poor anchoring of plain slurry expansion heads or poor pile foundation bearing capacity and poor integrity, and apply the variable-diameter reinforcing cage for expanded anchor rods or pile foundations with standard reinforcement cages as well as the anchor rods or pile foundations with the best cost performance.

The technical scheme of this invention: a variable-diameter reinforcing cage for an anchor rod or pile foundation has the core feature that the diameter of the reinforcing cage is variable; it includes an axial rod, a circular ring or ring plate, a plurality of vertical bars, several ribs, and circular fixators; the circular ring or ring plate is perpendicular to the axial rod; one end of the plurality of vertical bars is evenly fixed on the circular ring or ring plate; the other end or the middle of each vertical bar is connected to one end of a rib, and the other end of the rib is connected to the circular fixator or circular flower part; the circular fixator slides or is fixed on the axial rod so as to form a movable mechanism of the reinforcing cage; the plurality of vertical bars surround the axial rod; annular hoops are arranged on the periphery of the vertical bars to serve as circles of latitude; fixing points are formed on the annular hoops and the vertical bars; tightening of the annular hoops indicates that they are not in use; the annular hoops are spring hoops or flexible steel wires; the end of the annular spiral spring hoops is fitted with a release device; when flexible steel wires are used, the circular fixator is fitted with a release device for stretching out the vertical bars of the ribs. The variable-diameter reinforcing cage is fitted with a restraint and release device. The restraint methods including but not limited to restraint ropes, restraint pins, restraint covers, etc. can be adopted to make the diameter of the reinforcing cage in a reduced restraint state. The methods including but not limited to releasing springs, leaf springs, elastic balls, air bags, counterweights, rotation, applying external force, etc. can be used to expand and release and make the diameter of the reinforcing cage variable.

The second type of variable-diameter reinforcing cage for an anchor rod or pile foundation includes an axial rod, a plurality of vertical bars, at least two circular fixators and several groups of ribs which correspond to the circular fixators. The circular fixators are all sleeved on the axial rod or the pile foundation rod; each circular fixator is arranged in a circular manner and used for movably fixing a group of ribs of which the quantity is the same as that of the plurality of vertical bars; one end of the ribs is movably connected to the position of the vertical bars at the same height, and the other end of the ribs is movably connected to the circular fixators; that is, each vertical bar is movably connected to each group of ribs of at least two circular fixators at different heights, and the plurality of vertical bars surround the axial rod;

Annular hoops are arranged on the periphery of the vertical bars to serve as circles of latitude; fixing points are formed on the annular hoops and the vertical bars; the annular hoops are annular spiral spring hoops made of an elastic material or are flexible steel wires; tightening of the annular hoops indicates that they are not in use; the end of the annular spiral spring hoops is fitted with an annular hoop release device; when flexible steel wires are used, a release device for stretching out the ribs and vertical bars is mounted.

For the said variable-diameter reinforcing cage for an anchor rod or pile foundation, at least one circular fixator slides on the axial rod or the pile foundation rod, and the sliding circular fixator is fitted with a positioning device on the axial rod or the pile foundation rod.

For the said variable-diameter reinforcing cage for an anchor rod or pile foundation, the release device for stretching out the vertical bars is an external force release device, or a gravitational release device or an end release device of the said annular spiral spring hoops; the end release device is a shaft pin or shaft hole structure made from the end of the annular hoops; when the end of the annular spiral spring hoops is a shaft pin, it inserts a fixing hole; when the end of the annular spiral spring hoops is a shaft hole, there is a pin shaft for fixing the end of the hoops.

Typical structure of external force release: after the ribs similar to the lower part of FIG. 4-1 (when the variable-diameter reinforcing cage reaches the position, it is directly knocked or the ribs are vibrated, or a ferrule in the upper part of this circle of ribs is struck; the ferrule opens two ribs similar to the lower part of FIG. 4-1 during moving) are opened, the reinforcing cage is opened without retracting by use of the gravity of the vertical bars.

For the said variable-diameter reinforcing cage for an anchor rod or pile foundation according to claim 2, wherein when the peripheral circles of latitude are flexible steel wires, the release device for stretching out the ribs and vertical bars is the device for stretching out the umbrella ribs; flexible steel wires include steel wires include stranded steel wires, steel ropes, chain structures or wires with high tensile strength (such as carbon fibers, graphene and related carbon ropes).

For the said variable-diameter reinforcing cage for an anchor rod or pile foundation, the annular spiral spring hoops are at the inner ring position of the vertical bars to stretch out the vertical bars; when the annular spiral spring hoops and the circles of latitude are flexible steel wires, both the annular spiral spring hoops and the flexible steel wires form fixing points with the vertical bars; the fixing points can be binding or circular knots with a certain space.

For the said variable-diameter reinforcing cage for an anchor rod or pile foundation, the mode of movably connecting the ribs with the vertical bars: the circular fixator (which can be circular flower part) connects the ribs to the vertical bars by means of pin shafts 3-1 and pin shaft brackets (U-shaped fixed brackets) 3-2; the number of the vertical bar ribs is more than 3. It tends to be 6-8, and can also reach 12 or more.

The vertical bars are straight or curved. Pile foundations or anchor rods with various heads can be formed.

For the said variable-diameter reinforcing cage for an anchor rod or pile foundation, when the reinforcing cage is long, 1 or more circular fixators can be distributed uniformly on the shaft, at least 1 (but not limited to 1) circular fixator slides on the axial rod, and there is a stopper for limiting the sliding distance of the circular fixator.

When the peripheral circles of latitude are flexible steel wires, the sliding circular fixator is fitted with a release device for stretching out the vertical bars of the ribs; the release device for stretching out the vertical bars of the ribs is the spring device (similar to a spring) used to stretch out the circular fixators and sleeved on the axial rod stretches out at least 1 sliding circular fixator.

When the peripheral annular hoops are spiral springs or flexible steel circles of latitude, there is a spring sleeved on the axial rod; when the spring is in a state of compression or elongation stress, the circular fixator is constrained and locked or provided with a stopper; after unlocking or opening the stopper, the spring stress drives the circular fixator to slide on the axial rod, thus stretching out the ribs and extending the vertical bars.

When the circular fixators are a structure fixed on the axial rod, the circular fixators and the axial rod are an integrated structure. Here the periphery-perforated circular fixator can be directly welded to the axial rod (a circular fixator can also be machined on the axial rod).

For the said variable-diameter reinforcing cage for an anchor rod or pile foundation, according to the application requirements of specific projects and the variable-diameter principle of this invention, variable-diameter reinforcing cages with a variety of three-dimensional shape features can also be formed, including/but not limited to cylinders, polygonal (circle inner tangent) cylinders, truncated cones, cones (including circular cones and polygonal cones), trapezoidal cylinders, spheres, bamboo-shaped cylinders, etc.; according to the application performance requirements of specific projects and the variable-diameter principle of the invention, the variable-diameter reinforcing cage with ultra-large diameter for a pile foundation can also form a variable-diameter reinforcing cage characterized by dual-layer/or multi-layer cage-in-cage.

Annular hoops are arranged on the periphery of the vertical bars; fixing points are formed on the annular hoops and the vertical bars; the annular hoops are annular spiral spring hoops made of an elastic material or are flexible steel wires; tightening of the annular hoops indicates that they are not in use; the end of the annular spiral spring hoops is fitted with a restraint and release device; when flexible steel wires are used, a restraint and release device for stretching out the ribs and vertical bars is mounted at the circular fixator.

When the peripheral annular hoops are spiral springs or flexible steel circles of latitude, the release device for stretching out the vertical bars of the ribs has a (similar) device for opening the umbrella ribs.

When the annular spiral spring hoops and circles of latitude are flexible steel wires, both the annular spiral spring hoops and the flexible steel wires form fixing points with the vertical bars; the simplest fixing point is a wire binding structure (wire-tie). The fixing points can be circular knots with a certain space, so that the annular spiral spring hoops and flexible steel wires have a certain displacement at the vertical bars at the time of release.

The first type of variable-diameter reinforcing cage of this invention releases an umbrella shape (however, if the diameter of the circular ring or ring plate is large, FIG. 1 can also show a columnar shape); the axial rod, the circular ring or ring plate, a plurality of vertical bars (umbrella ribs), and several ribs show a similar umbrella rib (supporting rib) structure; but the circular ring or ring plate replaces the tip of the umbrella, and the annular spring hoops and the release structure perform the action of closing and opening an umbrella; the vertical bars may be straight rods like umbrella ribs, and the ribs are the support rods of the umbrella ribs; the ribs movably connect the circular fixators and vertical bars.

The second type of variable-diameter reinforcing cage is (cylindrical) columnar and is an umbrella structure of a pair of circular fixators; (three or more umbrella structures can also be arranged on the axial rod; that is, they are formed by a plurality of vertical bars, several ribs and a sliding or fixed circular fixator; the reinforcing cage used for large diameter (around 100 cm) can be a dual-layer cage structure; the umbrella structure of one pair of circular fixators releases the inner cage of the dual-layer cages; the umbrella structure of the second pair of circular fixators releases the outer cage of the dual-layer cages; this is slightly redundant, and this scheme does not go beyond the scope of this invention); the second type is more reasonable and its preparation is slightly complex.

Further, the first type of variable-diameter reinforcing cage: the diameter of the circular ring or ring plate is comparable to or slightly smaller than that of the drill hole; the ribs can be straight or curved. The circular ring or ring plate can be retained or replaced by a subulate guider (guide cap).

If at least one circular fixator is arranged to slide on the axial rod and there is a stopper limiting the sliding distance, the other circular fixator is fixed on the axial rod. When two circular fixators slide on the axial rod, two stoppers limiting the sliding distance can be mounted. A stopper may not be mounted (a stopping mechanism such as collision bead etc. is mounted), or the spring stress is used to release the expansion distance of the vertical bars.

When the annular hoops are elastic hoops, they hoop the inner ribs in the vertical bars. The vertical bars and hoops are simultaneously unfolded and closely attached at the expanded end to form a reinforcing cage. There are multiple types of elastic hoop and release structures. For example, the structure of a shaft pin or shaft hole machined from the end of the hoop is the most common; when it is a shaft pin, it inserts a fixing hole; when it is a shaft hole, there is a pin shaft for fixing the end of the hoop. In addition, this is convenient for release when necessary; i.e. the variable-diameter reinforcing cage is opened in the expanded hole.

The said variable-diameter reinforcing cage is fitted with a restraint and release device. The restraint methods including but not limited to restraint ropes, restraint pins, etc. are adopted to make the diameter of the reinforcing cage in a reduced restraint state. The means including but not limited to springs, elastic rods, leaf springs, elastic rings, elastic balls, compression bags, hydraulic jacking (rods), pneumatic jacking (rods) or other materials are adopted. The methods of opening the variable-diameter reinforcing cage include but are not limited to: springs, leaf springs, elastic rings, elastic balls, elastic rods, compression bags, counterweights, dead weights, vibration, rotation, hydraulic jacking (rods), pneumatic jacking (rods), high pressure gas or liquid impact, etc.

For the expanded anchor rod or pile foundation of the pressure-bearing variable-diameter reinforcing cage of the invention, when placed in the expanded section, the variable-diameter reinforcing cage is stretched out and released. A grouting or concreting conduit mechanism is mounted on the variable-diameter reinforcing cage so as to form an anchor rod or pile foundation during grouting or concreting, and the variable-diameter reinforcing cage becomes the framework of the anchor rod or pile foundation.

The materials used by the said variable-diameter reinforcing cage and its components include but are not limited to steel products, steel pipes, steel strands, glass fibers, resins, glass fiber reinforced resins, aramid fibers, carbon fibers, graphene, carbon related materials and composite materials, polymers, polymer materials, nano materials, metallic materials and non-metallic materials. The various parameters of the said variable-diameter reinforcing cage and its component including position, specification, model, shape, quantity, size, and material can be adjusted according to the specific needs of different specifications of products. For example, the circular fixators use umbrella flower parts or other shapes.

The shapes of the said variable-diameter reinforcing cage and its components include/but are not limited to cylinders, polygonal (circle inner tangent) cylinders, truncated cones, circular cones and polygonal cones, trapezoidal cylinders, spheres, bamboo-shaped cylinders, etc. The sectional planar shapes include circles and ellipses, sectors, arches, and circular rings. The shapes also include triangles, trapezoids, parallelograms, diamonds, rectangles, squares, kites, pentagons, hexagons, and polygons with larger side length. According to the application performance requirements of specific projects and the variable-diameter principle of this invention, the variable-diameter reinforcing cage with ultra-large diameter for a pile foundation can also form a variable-diameter reinforcing cage characterized by dual-layer/or multi-layer cage-in-cage. There are various preparation methods for the variable-diameter reinforcing cage: 3D printing, injection molding, manual and mechanical assembling and welding, manual and mechanical assembling and binding, etc.

The variable-diameter reinforcing cage of this invention is combined with tension rods including but not limited to various specifications and grades of steel bars, steel strands and wire ropes to form an integral expanded anchor rod. Further, the reinforcing cage is combined with various specifications of steel columns, section steel or non-reducing reinforcing cage concrete structures (columns/or piles) to form an integral expanded pile foundation. The anchor rod adopts a bright-rolled threaded steel bar, and the steel bar connector is used for the length connection at the end of the bright-rolled threaded steel bar. The top of the anchor rod is anchored to the floor, and the bottom of the anchor rod is anchored to the expanded head reinforcing cage, i.e. the variable-diameter reinforcing cage.

The application method of this invention: a rotary jet pile driver performs drilling to the design depth→high pressure rotary jet construction or mechanical reaming construction→run an anchor head (or pile hole)→open the expansion mechanism in the anchor head (or pile hole); open the reinforcing cage to the design size→high pressure grouting or concreting.

The circles of latitude for the variable-diameter reinforcing cage can become elastic steel bars i.e. hoops after special processing of common steel bars. The processed elastic steel bars are machined into small diameter hoops (to hoop the entire vertical bars or ribs by means of tight encircling or tightening). That is, the entire vertical bars or ribs are hooped by means of tight encircling or tightening; annular hoops are arranged on the periphery of the vertical bars; fixing points are formed on the annular hoops and the vertical bars (steel wire binding is the most common). When the card or buckle of the end of the elastic steel bar by means of tight encircling or tightening is released at the fixing point, it is loosened, and the diameter of the variable-diameter reinforcing cage is changed (diameter enlargement) so as to form a large diameter reinforcing cage and the reinforcement cage for an anchor rod or pile foundation.

For the second type of variable-diameter reinforcing cage, the circles of latitude can be steel strands or wire ropes evenly enwound or sleeved on the periphery of the vertical bars; the restraint and release mechanism is an opening device with double umbrella ribs; the vertical bars are equivalent to the skeleton of the umbrella ribs or the coaxial double umbrella rib structure for release; the circles of latitude become polygonal annular hoops; when the number of vertical bars is 8, the circles of latitude become an octagon.

Typical finished products: after the reinforcing cage is compressed, the diameter of the circles of latitude is generally ≤200 mm (parameter related to the actually formed drill hole; for different drill holes, there may have different diameters of reinforcing cages (hoops); after placement in the expansion section of the anchor rod, the restraint mechanism in the reinforcing cage is opened, and its diameter reaches about 400 mm (can also be ≤150 mm after hooping; the post-expansion diameter up to 200-350 mm); the height of a reinforcing cage is 1200-1600 mm in general. As needed, it is not excluded that the expanding diameter of a reinforcing cage can reach about 500-2000 mm or more. The reinforcing cage uses a large-size axial rod and large-size vertical bars; then the diameter of the circles of latitude after hooping is generally ≤300-800 mm, and the length is increased or reduced as needed. The circles of latitude can be spiral lines or circumferences uniformly distributed on the vertical bars or grid-shaped structures.

The vertical bars or ribs are unfolded and cling to the hoops under the action of the mechanism until they can be unfolded; the anchor rod is mechanically connected to the expanded head at the bottom of the expansion section, i.e., at the bottom of the anchor rod, with an anchor backing plate (it is a ring plate). The expanded head variable-diameter reinforcing cage, anchor rod, and anchoring parts are bonded with concrete or cement slurry crystals to form an expanded head anchor or rod/pile system of the variable-diameter reinforcing cage.

For the bearing type variable-diameter reinforcing cage expanded head anchor rod technology, see the design, construction and acceptance in the JGT/T282-2012 Technical Specification for Under-reamed Anchor by Jet Grouting. The applications of this invention all belong to the applications of expanded head anchor rods or large head pile foundation technology.

According to the application requirements of specific projects and the principle of this invention, variable-diameter reinforcing cages with a variety of three-dimensional shapes can also be formed, including/but not limited to cylinders, polygonal cylinders, cones, trapezoidal cylinders, bamboo-shaped cylinders, etc. In addition, according to the application performance requirements of specific projects and the variable-diameter principle of the invention, the variable-diameter reinforcing cage with ultra-large diameter for a pile foundation can also form a variable-diameter reinforcing cage characterized by dual-layer/or multi-layer arrangement of vertical bars (cage-in-cage).

Beneficial effects: the "bearing type variable-diameter reinforcing cage expanded head anchor pile" scheme of the invention can form a tension or resistance transmission anchor rod with sufficient friction; the anchoring force is obviously increased and the overall integrity of the anchor rod is good; the scheme is also used for bearing type expanded head concrete pile foundations. This invention is used mainly in anti-floating foundation pit supporting, slope supporting, reinforcement, etc. for building basements. It uses a small quantity of materials and a low cost technology and can meet the construction requirements of larger pile foundations or anchor rods for reducing high costs. The invention is an improvement and innovation of the expanded head part in the traditional high-pressure jet expanded head anchor rod or pile foundation technology. After adding a variable-diameter reinforcing cage in the expanded head section, a cement and concrete expanded head pile with a variable-diameter reinforcing cage is formed, thereby improving overall force, anchoring section stability, durability, uplift capacity, bearing capacity, etc. to a large extent. The technology of this invention can provide larger uplift resistance or compressive resistance and stable and reliable performance; in addition, the variable-diameter reinforcing cage system is fully assembled, and has great convenience and a good effect on speeding up the progress of projects.

IV. BRIEF DESCRIPTION OF THE DRAWINGS

FIGS. 1-1, 1-2 and 1-3 are all the structure diagrams of the variable-diameter reinforcing cage of this invention; FIG. 1-1 shows the unwinding release structure of the tension spring; FIG. 1-2 shows the unwinding release structure of the compression spring; FIG. 1-3 shows the unwinding release structure of the compression spring for sliding of the double circular fixators.

FIG. 2 is the structure diagram of the expanded anchor rod;

FIGS. 3-1 and 3-3 are the schematics of the tightening structure of this invention; FIG. 3-1 is the structure diagram of loop bar tightening without spring; FIG. 3-3 is the structure diagram of loop bar tightening with spring; FIG. 3-2 is the partial schematic of replacing the chassis 12 with the guide cap 14 in the lower part of FIG. 3-1; FIG. 3-4 is the partial schematic of replacing the chassis 12 with the guide cap 14 in the lower part of FIG. 3-3.

FIG. 4-2 is the schematic of the other release structure (loop bar with spring) of the invention;

FIG. 5-1 is the structure diagram of the circular flower part of the B-B cross section in FIG. 4;

V. DETAIL DESCRIPTION OF EMBODIMENTS

Figure 1:
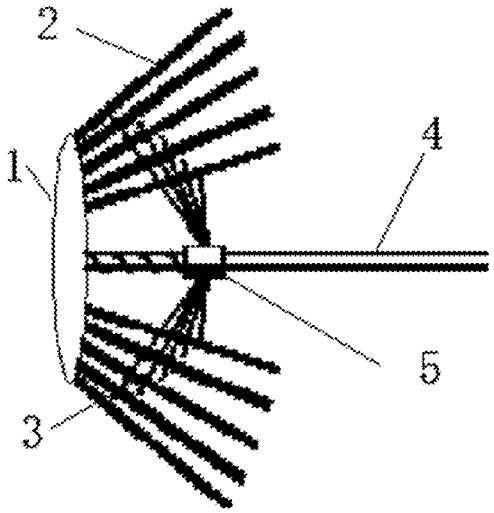
FIG. 4-1 is the schematic of the release structure of the invention.

The components shown in the figures include: axial rod 4, circular ring or ring plate 1, a plurality of vertical bars 2, ribs 3, circular fixators 5, annular hoops 6, steel ring 6-1 at the end of the hoops (for fixing and release) , the connecting point 7 of the annular hoop with the axial rod 4, release mechanism 8, socket 8-1 matching with the annular hoop steel ring, steel tray and steel pipe welding 9, counterweight 10, stopper 10-1, the first bracket 11 and the second bracket 11-1, chassis 12, steel tray (i.e., the circular fixator or the circular flower part) 13, ribs 3 which may be flat rods; pin shaft 3-1, pin shaft bracket (U-shaped fixed bracket) 3-2, notch 3-3.

Figures 1, 2:
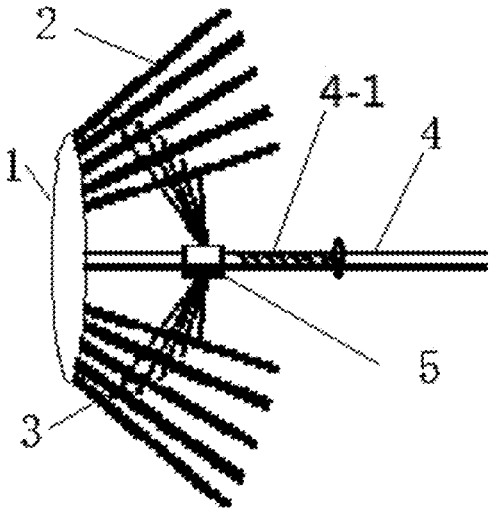

The basic structure of this invention is shown in FIGS. 1 and 2: a variable-diameter reinforcing cage, including an axial rod, a circular ring or ring plate, a plurality of vertical bars, and several ribs; the circular ring or ring plate is perpendicular to the axial rod; the axial rod can be made of steel pipes, hollow steel pipes, steel bars or other materials; one end of the plurality of vertical bars is uniformly fixed on the circular ring or ring plate; the other end or the middle of each vertical bar is connected to one end of a rib, and the other end of the rib is connected to one circular fixator; the circular fixator is fixed on the axial rod or the pile foundation rod. Ribs 3 are similar to the straight rods of umbrella ribs.

Figures 1, 2, 3:
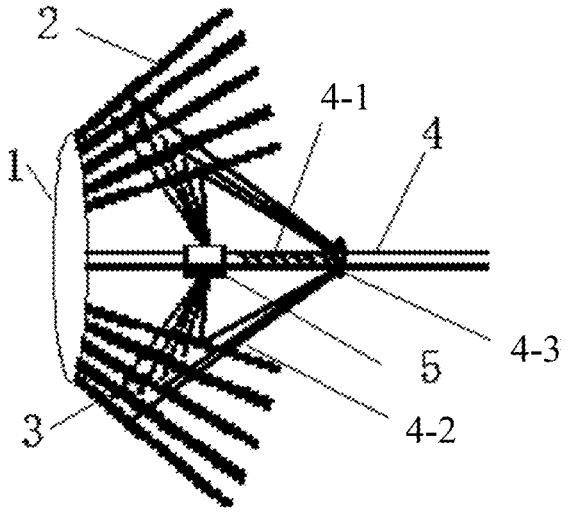
Figure 2:
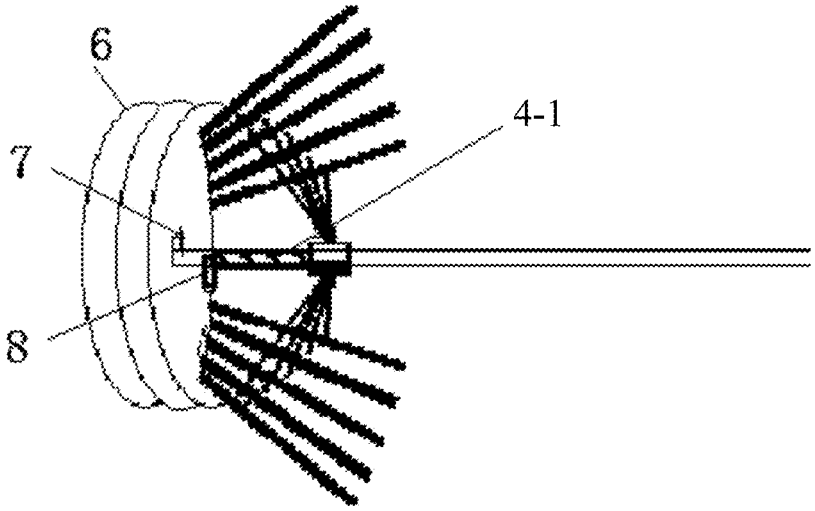
Figures 1, 3:
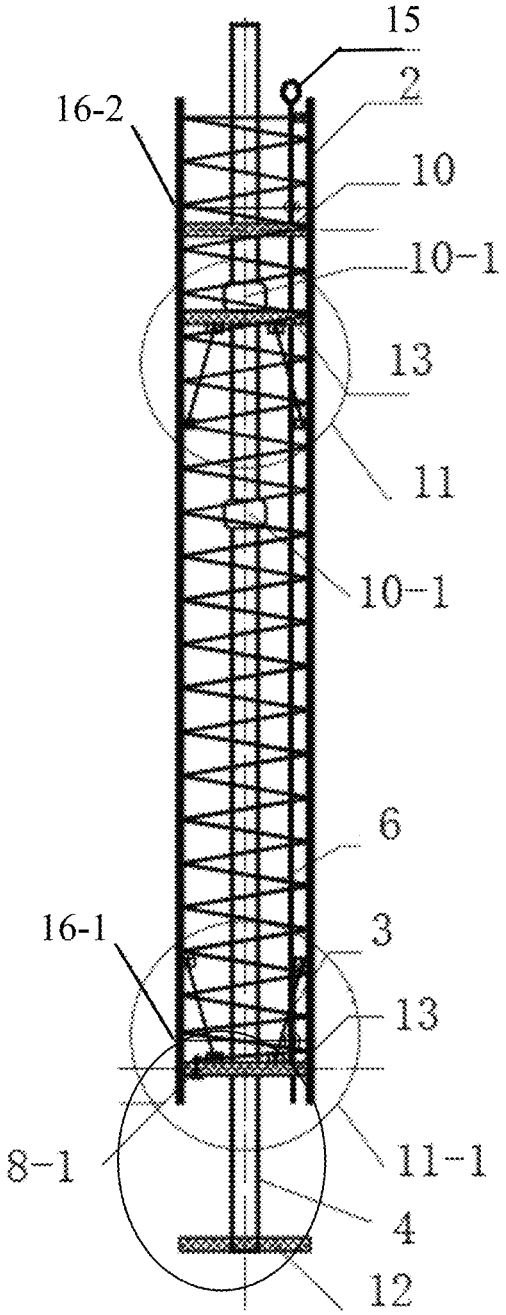
Figures 2, 3:
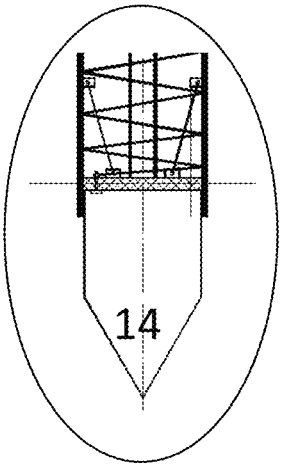
Figure 3:
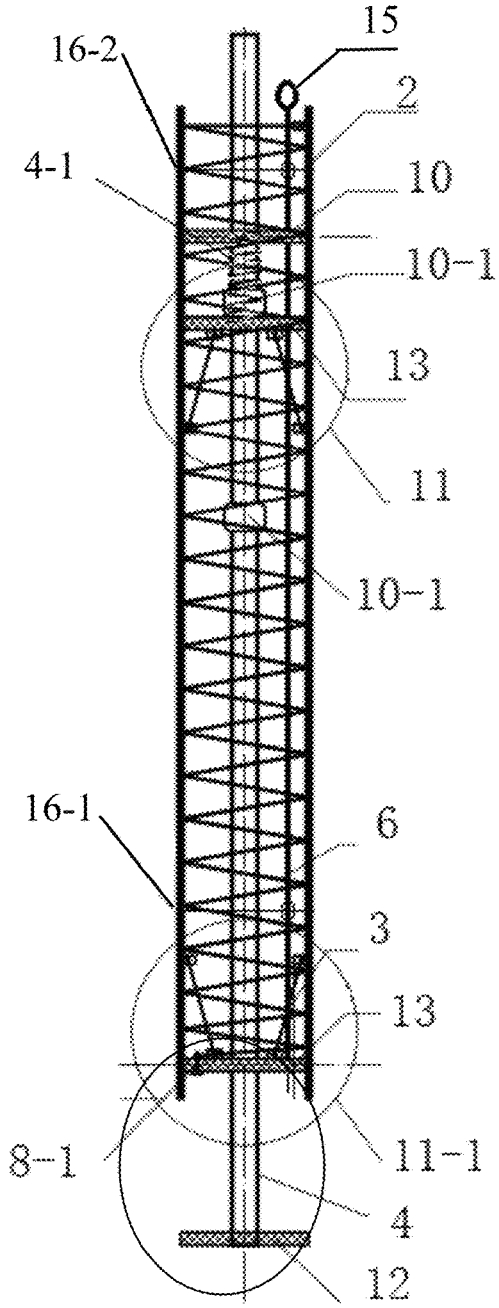
Figures 3, 4:
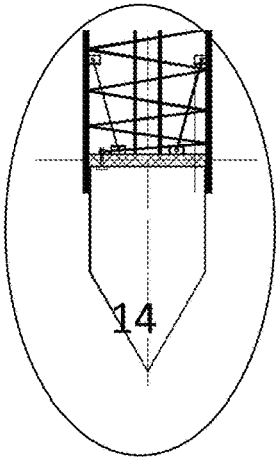
Figures 1, 4:
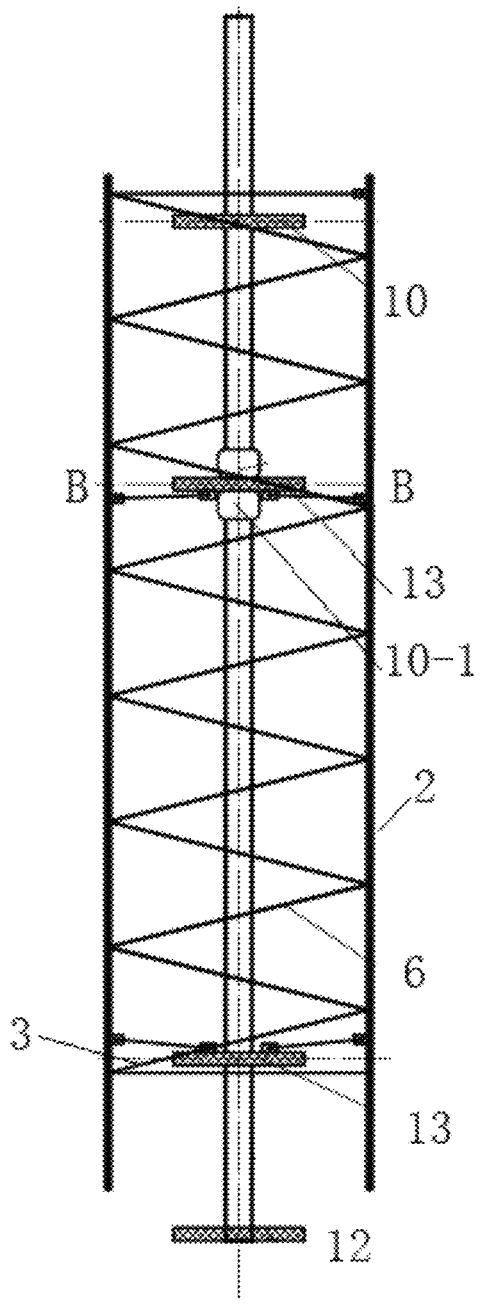
Figures 2, 4:
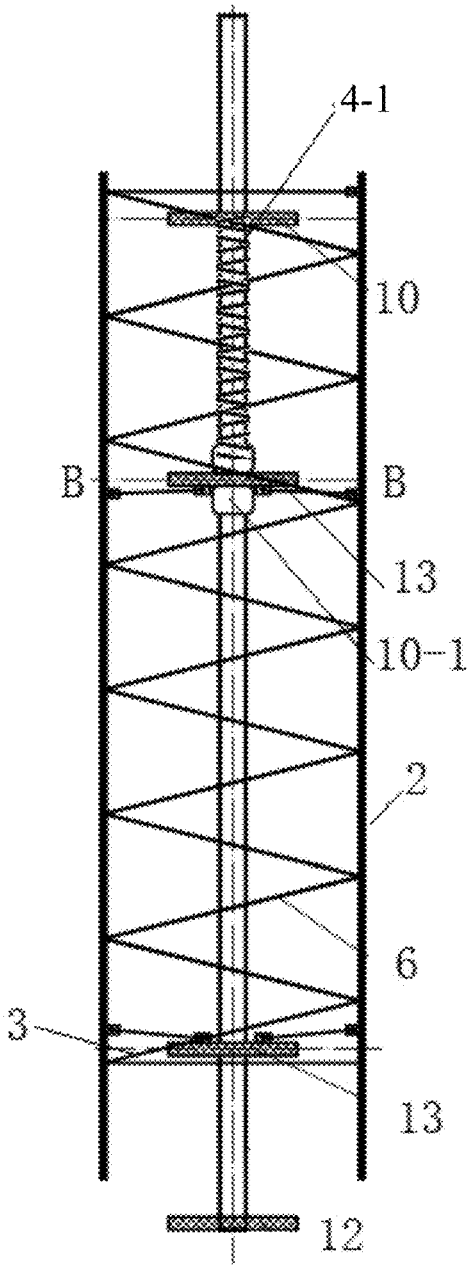
Figure 5:
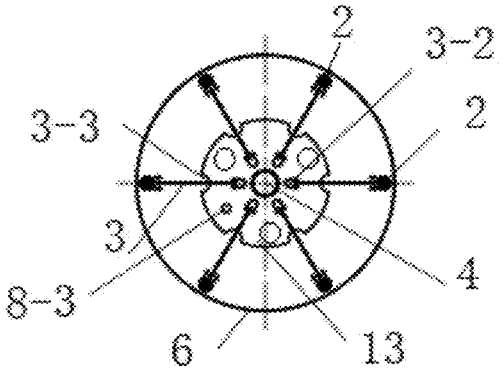
FIG. 5 is the structure diagram of the B-B cross section in FIG. 4.
Figures 1, 5:
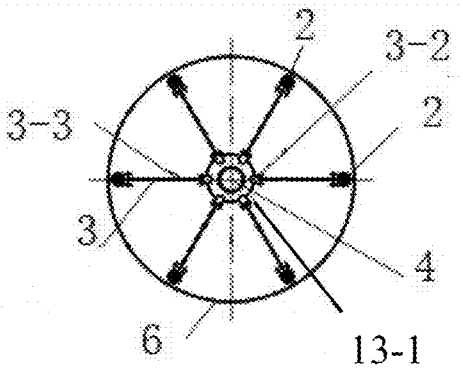
Figure 6:
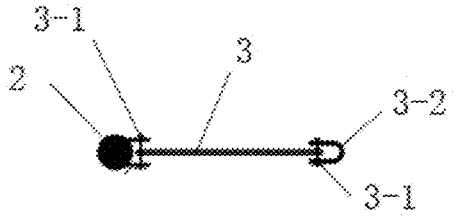
FIG. 6 is the structure diagram of connection of rib 3 in FIG. 5.
Figure 7:
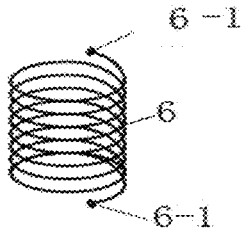
FIG. 7 is the structure diagram of the outer annular hoop 6 (spiral)
Figure 8:
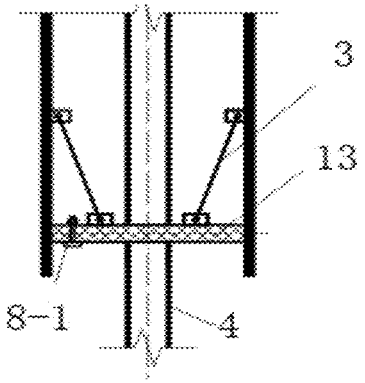
FIG. 8 is the schematic (enlarged view) of the tightening structure of the second bracket.
Figure 9:
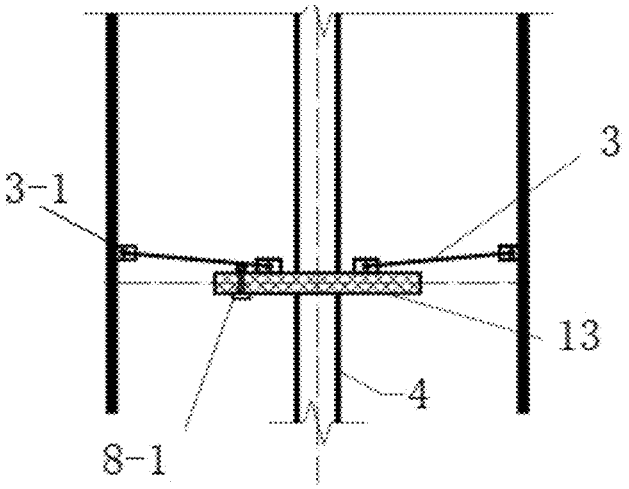
FIG. 9 is the schematic of the release structure of the second bracket.

FIGS. 3 and 4 are the schematics of the tightening structure and release structure of this invention; the number of the vertical bars is 6, and actually, it can be 3 or more; when the circles of latitude are steel strands, steel ropes, etc., the cross section is polygonal during opening of the variable-diameter reinforcing cage.

In FIGS. 3 and 4, the vertical bars are straight rods vertically distributed in parallel to the axial rod, and can also be distributed in a uniform oblique line manner; In FIGS. 3-1 and 3-3, 15 is a restraint pin, and 16-1 and 16-2 are restraint ropes;

The vertical bars of the first type of reinforcing cage in FIGS. 1 and 2 are distributed generally in a uniform oblique line manner. One end of the plurality of vertical bars is uniformly fixed on the circular ring or ring plate; the other end or the middle of each vertical bar is connected to one end of a rib, and the other end of the rib is connected to the circular fixator; the circular fixator slides on the axial rod (pile foundation rod). The vertical bars can be vertically distributed in parallel to the axial rod after the other end of the ribs is connected to the circular fixator and opened when the diameter of the circular ring or ring plate fixed with one end of the plurality of vertical bars is large.

The vertical bars may also have a toothed shape or an arc shape; then after the variable-diameter reinforcing cage is opened, more than 6 vertical bars distributed uniformly become a spherical or toothed structure.

Annular hoops are arranged on the periphery of the vertical bars of the variable-diameter reinforcing cage, and are made of an elastic material. The annular hoops can be in the shape of a spiral spring. Tightening of the annular hoops indicates that they are not in use (for placing in drill holes); the end of the hoops is fitted with a release device. In the non-use state of tightening and elastic restraint, after the annular hoops are released, the diameter is changed, and increased to be in the original relaxed state of the annular hoops; that is, after small diameter annular hoops are released to the expanded end of the anchor rod or pile foundation, the diameter of the annular hoops is enlarged to the value required by the design (e.g. for a typical model, the diameter is enlarged from less than 200 mm to 400 mm).

There are two types of release devices for stretching out the vertical bars of the ribs. The first type is the elastic locking of the annular spiral spring hoops: annular spiral spring hoops are arranged on the periphery of the vertical bars (hoops can also be arranged on the inner perimeter of the vertical bars to open the vertical bars at their inner ring position); fixing points are formed on the annular spiral spring hoops and the vertical bars; the hoops are the annular spiral spring hoops made of an elastic material. Tightening of the annular hoops indicates that they are not in use; the end of the annular spiral spring hoops is fitted with a release device. The end of the said annular spiral spring hoops is fitted with a release device. The end of the hoops is machined into the structure of a shaft pin or shaft hole; when the end of the spiral spring hoops is a shaft pin, it inserts a fixing hole; when it is a shaft hole, there is a pin shaft for fixing the end of the hoops.

The second type is the release device for opening the vertical bars of the ribs at the circular fixator when flexible steel wires are used. When the peripheral circles of latitude are flexible steel wires, the release device for opening the vertical bars of the ribs is the spring (similar) device of the loop bar for opening the umbrella ribs to stretch out at least one sliding circular fixator.

The first type of variable-diameter reinforcing cage shown in FIGS. 1-1 to 1-3 includes an axial rod, a circular ring or ring plate, a plurality of vertical bars, several ribs, and circular fixators; the circular ring or ring plate is perpendicular to the axial rod; one end of the plurality of vertical bars is uniformly fixed on the circular ring or ring plate; the other end or the middle of each vertical bar is connected to one end of a rib, and the other end of the rib is connected to the circular fixator; the circular fixator slides on the axial rod (pile foundation rod). The plurality of vertical bars surround the axial rod; annular hoops are arranged on the periphery of the vertical bars; fixing points are formed on the annular hoops and the vertical bars; the annular hoops are flexible steel wires. When flexible steel wires are used, a release device for opening the vertical bars of the ribs is arranged at the circular fixator: there is a spring sleeved on the axial rod; when the spring is in a state of stress (compression or elongation), the circular fixator is locked or provided with a stopper; after unlocking or opening the stopper, the spring stress drives the circular fixator to slide on the axial rod (pile foundation rod). Moreover, the spring stress drives the ribs to stretch out and makes the vertical ribs extend outside, showing an action of opening an umbrella. FIG. 1-1 shows the unwinding release structure of the tension spring; FIG. 1-2 shows the unwinding release structure of the compression spring; FIG. 1-3 shows the unwinding release structure of the compression spring for sliding of the double circular fixators (it can also be used for the reinforcing cage with double circular fixators shown in FIG. 2-FIG. 3), or an automatic umbrella opening structure. There is a stopper fixed on the axial rod for fixator sliding; when the stopper is released, the spring's elastic force drives the fixator to slide. When the diameter of the circular ring or ring plate is the same as the diameter after circular fixator releasing and rib opening, the vertical bars can also be parallel to the axial rods to form a cylindrical reinforcing cage. When the diameter of the circular ring or ring plate is different from the diameter after circular fixator releasing and rib opening, the vertical bars form a round table-shaped reinforcing cage.

4-1 is the spring sleeved on the axial rod, 4-2 is the second rib, and 4-3 is the second circular fixator. The second rib is connected between the second circular fixator and the vertical bar. The second circular fixator and the circular fixator both slide on the axial rod, and the spring 4-1 is arranged between the second circular fixator and the circular fixator 5. When the vertical bars are contracted, the sliding distance of the rib on the axial rod (to the right) is longer than that of the second rib. The spring 4-1 is arranged between the second circular fixator and the circular fixator 5, and is compressed. A stopper is arranged inside the axial rod to stop the second circular fixator or the circular fixator. When the stopper is released, the second circular fixator and the circular fixator automatically move to the left under the action of spring force to stretch out the surrounding vertical bars.

The release structure of the second variable-diameter reinforcing cage is identical with or similar to that of the first variable-diameter reinforcing cage: it is allowed to use only a spring including a tension spring or a compression spring sleeved on the axial rod to drive one sliding circular fixator (the other circular fixator is fixed) while releasing two pairs of ribs (to drive the vertical bars). The tension spring or the compression spring acts on the two sliding circular fixators while releasing two pairs of ribs. Either the tension spring or the compression spring can act on one sliding circular fixator while releasing two pairs of ribs. One pair of tension springs or compression springs can also be used to simultaneously drive the two sliding circular fixators while releasing two pairs of ribs. The size of the tension spring or compression spring can be fixed by the limiting card or the circular fixator is stopped or limited by the limiting card at the elastic stress position of the tension spring or compression spring; when the limiting card or stopper is released, the variable-diameter reinforcing cage is released.

The spring sleeved on the axial rod and the annular spiral spring hoops can be used simultaneously.

Another more specific embodiment is shown in FIG. 3-FIG. 9. In FIG. 1-FIGS. 2 the circular fixator sleeved on the main shaft or the axial rod or the hollow shaft is the steel tray 13. Both the first bracket 11 and the second bracket 11-1 are provided with a steel tray 13; then the two steel trays 13 of the first bracket 11 and the second bracket 11-1 are the first and second circular fixators, similar to the two umbrella opening and closing (corresponding to release and tightening) joints sliding on the axial rod 4). On the first bracket 11 and the second bracket 11-1, the ribs of each group are 6-10 flat steel bars; one end of the ribs is connected to the steel tray, and the other end of the ribs is connected to the vertical bar 2. The first and second circular fixators, that is, the two steel trays, connect the ribs to the vertical bars and movably fix them through the pin shaft 3-1 and the pin shaft bracket (U-shaped fixed bracket) 3-2.

The two circular fixators in the first bracket (i.e., the assembly) 11 and the second bracket (i.e., the assembly) 11-1 respectively stretch out the ribs to movably fix the two positions of each vertical bar 2; the steel tray can slide on the axial rod 4. The vertical bar 2 is retracted when the steel tray slides so that the ribs are in the vertical direction. The vertical bar 2 is stretched (released) when the steel tray slides so that the ribs are in the transverse stretching direction. The chassis 12 is fixed at the end of the axial rod 4 to facilitate the placement of the device into the drill hole, and the axial rod 4 is sleeved with a drive spring 4-1. The rib 3 can be a flat rod; the pin shaft 3-1 and pin shaft bracket (U-shaped fixed bracket) 3-2 are mounted on the steel tray 13 and vertical bar 2; the steel tray 13 is provided with the notch 3-3 and the socket 8-1 matching with the annular hoop steel ring.

The structure of the annular hoop 6 (spiral and suitably elastic, which can be restrained and released; the diameter during restraining is half of that during releasing, or the diameter during releasing can be 10-35 cm larger than that during tightening and restraining) can be used again. The end of the hoop is fitted with the steel ring 6-1, which is the component of the release mechanism of the annular hoop 6; the annular hoop steel ring 6-1 matches with the socket 8-1 matching with the annular hoop steel ring on the steel tray 13; a latch is inserted into the steel ring 6-1 and the socket 8-1 to restrain the annular hoop to be in a state of tightening; pull the latch out to release the elastic annular hoop. Typical application parameters: the diameter is 200 mm in the tightening structure state and 400 mm in the release structure state. Other specifications of variable-diameter reinforcing cages have only to match with various drill hole diameters and application requirements.

Figure 10:
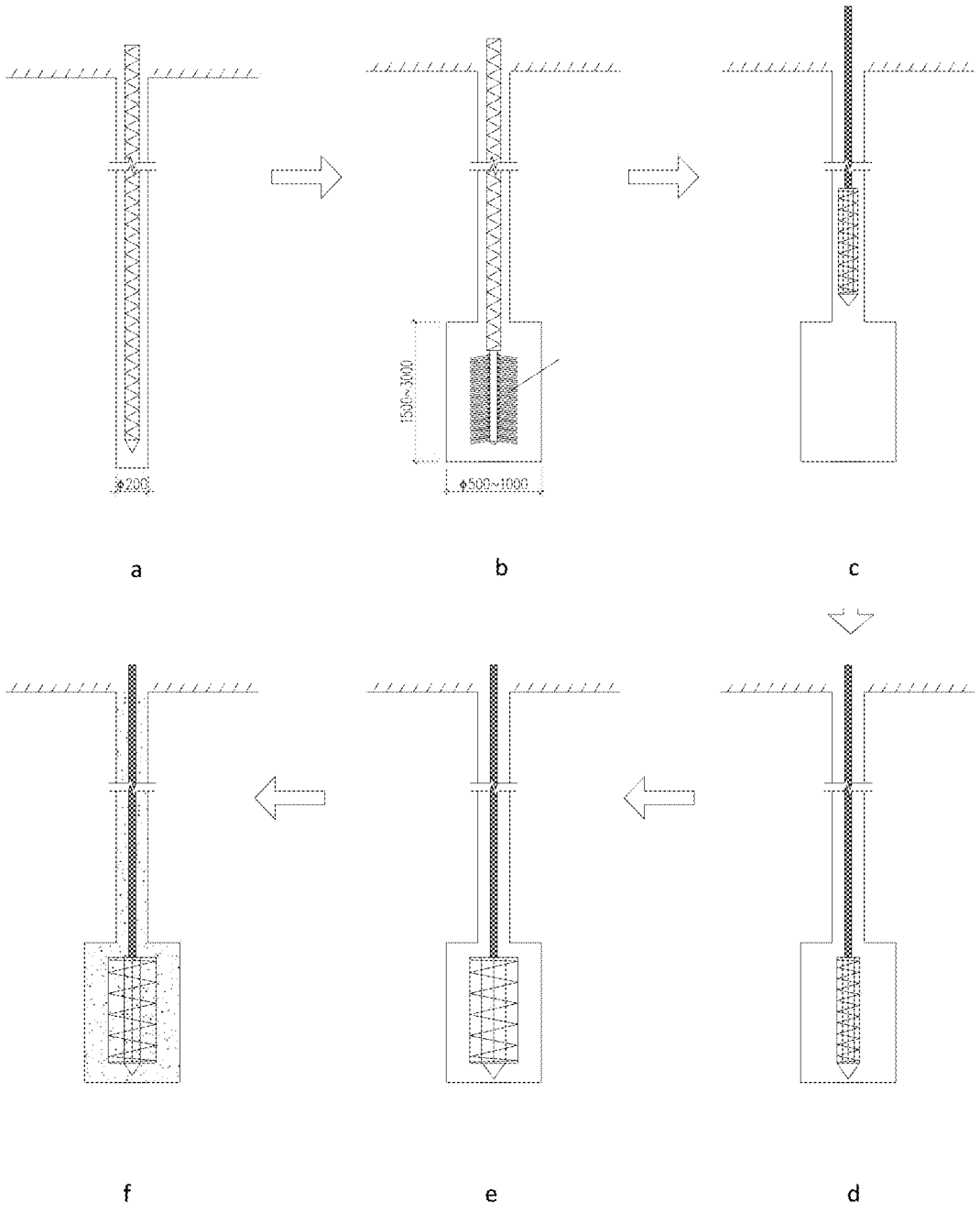
FIG. 10 is the process flow schematic. In the figure: hole drilling a→reaming b→run an anchor head c→open the expansion mechanism in the anchor head d→open the reinforcing cage to the design size e→high pressure grouting or concreting f.
Figure 11:
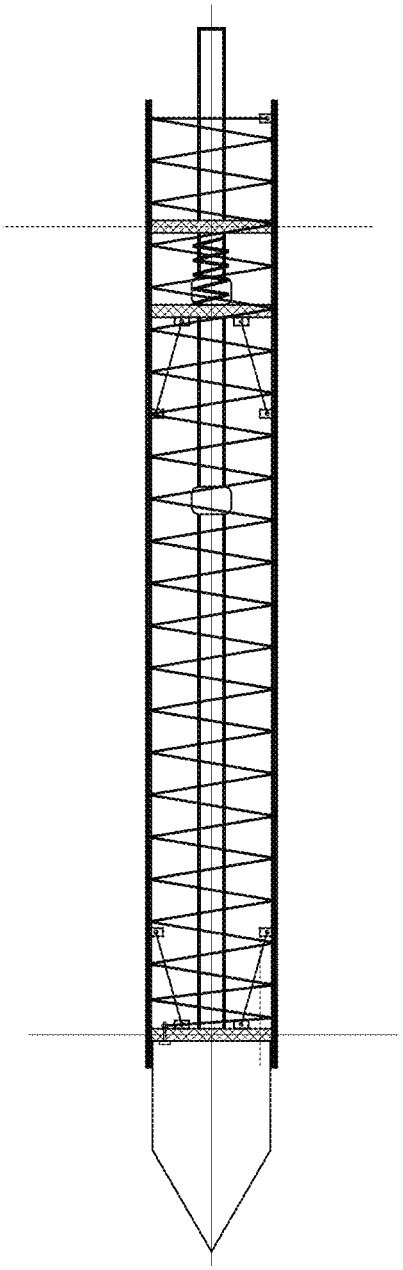
FIG. 11 is the structure diagram of the variable-diameter reinforcing cage at the time of tightening.
Figure 12:
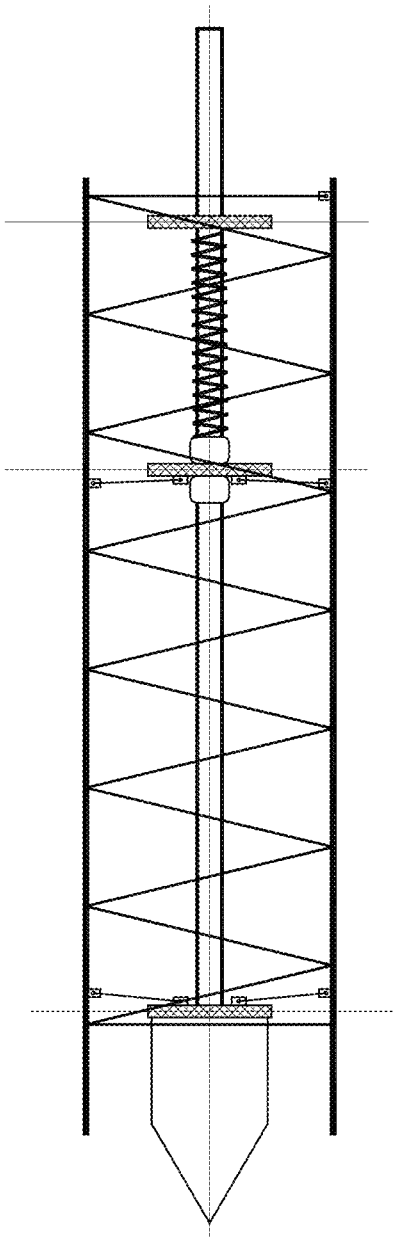
FIG. 12 is the structure diagram of the variable-diameter reinforcing cage product after restraint mechanism opening.

The application process in FIG. 10: positioning→cement slurry preparation→a rotary jet pile driver performs drilling to the design depth (hole drilling a)→high pressure rotary jet construction or mechanical reaming construction (reaming b)→run an anchor head c→open the expansion mechanism in the anchor head d, e→open the reinforcing cage to the design size (a large pile hole can reach more than 1 meter or nearly 2 meters; the reinforcing cage and axial threaded steel bars use the three-piece nut anchoring mode or a flange nut anchoring structure or other traditional anchoring modes)→high pressure grouting or concreting f.

The construction and application process of the variable-diameter reinforcing cage:

a. After special processing (quenching etc.), spring steel bars or ordinary steel bars become elastic steel bars; after processing and tightening, elastic steel bars become small diameter hoops; or the spring sleeved on the axial rod, and the stress of the spring is enough to drive the circular fixator to open the rib.
b. Finished reinforcing cage product: the reinforcing cage hoop diameter ≤200 mm; after placement in the expansion section of the anchor rod, the restraint mechanism in the reinforcing cage is opened, and the diameter of the hoop is up to 400 mm;
c. The vertical bars are unfolded and cling to the hoops under the action of the mechanism until they can be unfolded; high pressure grouting or concreting to form a pile;
d. A chassis, that is, an anchor backing plate, is used at the bottom of the expansion section to mechanically connect the rod body with the expanded head. The anchor backing plate, that is, the chassis 12 can also be replaced by the guide cap 14 etc.; when the guide cap is used instead, the bottom movable chassis anchor plate is a bearing anchor backing plate.

The applications of this invention include anti-floating piles, tensile piles (anchor rods), slope protection piles (anchor rods), pressure-resistant bearing engineering piles, as well as pile foundations or anchor rods for geological disaster control.

The prevent invention has advantages such as energy saving and environmental protection, work efficiency improvement, reduction of cost and construction period, a wide range of engineering applications, high safety and reliability, easy quality monitoring, inspection and review, and easy detection of the shape and location of metals by means of X-ray etc.

The above is only an embodiment of this invention and is not intended to limit the invention. Any modification, equivalent replacement, improvement, etc. within the spirit and principle of the invention shall be included in the protection scope of the present invention.

We claim:

1. A variable-diameter reinforcing cage for an anchor rod or pile foundation rod is characterized in that said reinforcing cage includes an axial rod,
a plurality of sets vertical bars,
at least two circular fixators and
a plurality of groups of ribs, corresponding to each circular fixator;
wherein
the circular fixators are all sleeved on the axial rod or the pile foundation rod;
each circular fixator is arranged in a circular manner and used for movably attaching the plurality of groups of ribs, a quantity of the plurality of the groups of ribs is the same as that of the plurality of sets of vertical bars;
one end of each rib is movably connected to each vertical bar at a same height position with respect to the axial rod,
and the other end of each rib is movably connected to the circular fixators;
that is, each vertical bar is movably connected to each rib which in turn attaches to a circular fixator at a different height position, and the plurality of sets of vertical bars surround the axial rod;
outer circumference of the vertical bars is provided with annular hoops as an outer weft;
fixing points are formed on the annular hoops and the vertical bars;
the annular hoops are annular spiral spring hoops made of an elastic material or are flexible steel wires;
annular hoops are configured to be adjusted between different use conditions; end of the annular spiral spring hoops is fitted with an annular hoop restraint and release device; when flexible steel wires are used, a restraint and release device for stretching out the vertical bars and ribs is mounted.

2. The variable-diameter reinforcing cage according to claim 1, wherein at least one circular fixator slides on the axial rod or the pile foundation rod, and the sliding circular fixator is fitted with a positioning device on the axial rod or the pile foundation rod.

3. The variable-diameter reinforcing cage according to claim 1, wherein the release device for stretching out the vertical bars is an end release device of the annular spiral spring hoops; the end release device is a shaft pin or shaft hole structure made from an end of the annular hoops; when an end of the annular spiral spring hoops is a shaft pin, it inserts a fixing hole; when the end of the annular spiral spring hoops is a shaft hole, there is a pin shaft for fixing the end of the hoops.

4. The variable-diameter reinforcing cage according to claim 1, wherein when the outer weft are flexible steel wires, the release device for stretching out the ribs and vertical bars is the device for stretching out the plurality of the groups of ribs; flexible steel wires include steel wires include stranded steel wires, steel ropes, chain structures or tensile wires.

5. The variable-diameter reinforcing cage according to claim 1, wherein the annular spiral spring hoops are at the inner ring position of the vertical bars to stretch out the vertical bars; when the annular spiral spring hoops and the outer weft are flexible steel wires, both the annular spiral spring hoops and the flexible steel wires form fixing points with the vertical bars; the fixing points can be binding or circular knots with a certain space.

6. The variable-diameter reinforcing cage according to claim 5, wherein the vertical bars are straight or curved.

7. The variable-diameter reinforcing cage according to claim 1, wherein the mode of movably connecting the ribs with the vertical bars: the circular fixator connects the ribs to the vertical bars by means of pin shafts and pin shaft brackets;

the number of the vertical bar ribs is more than 3.

8. The variable-diameter reinforcing cage according to claim 1, wherein more than 2 circular fixators are distributed uniformly on the shaft, at least 1 circular fixator slides on the axial rod, and there is a stopper for limiting a sliding distance of the circular fixator.

9. The variable-diameter reinforcing cage according to claim 1, wherein when the outer weft are flexible steel wires, the sliding circular fixator is fitted with a release device for stretching out the vertical bars of the ribs; the release device for stretching out the vertical bars of the ribs is the spring device used to stretch out the circular fixators and sleeved on the axial rod stretches out at least 1 sliding circular fixator.

10. The variable-diameter reinforcing cage according to claim 1, wherein when the peripheral annular hoops are spring hoops or flexible steel outer weft, there is a spring sleeved on the axial rod; when the spring is in a state of compression or elongation stress, the circular fixator is constrained and locked or provided with a stopper; after unlocking or opening the stopper, the spring stress drives the circular fixator to slide on the axial rod, thus stretching out the ribs and extending the vertical bars.

11. The variable-diameter reinforcing cage according to claim 1, wherein when the circular fixators are a structure fixed on the axial rod, the circular fixators and the axial rod are an integrated structure.

12. The variable-diameter reinforcing cage according to claim 1, wherein according to the application requirements of specific projects and the variable-diameter principle, variable-diameter reinforcing cages with a variety of three-dimensional shape features are formed, including cylinders, polygonal cylinders, truncated cones, cones, trapezoidal cylinders, spheres, and bamboo-shaped cylinders; according to the application performance requirements of specific projects, the variable-diameter reinforcing cage with ultra-large diameter for a pile foundation forms a variable-diameter reinforcing cage characterized by dual-layer cage-in-cage.

* * * * *